US007202806B2

(12) United States Patent
Mukaida

(10) Patent No.: US 7,202,806 B2
(45) Date of Patent: Apr. 10, 2007

(54) TRANSMITTER FOR RADIO CONTROL

(75) Inventor: Kenji Mukaida, Tokyo (JP)

(73) Assignee: Nikko Co., Ltd. (JP)

( * ) Notice: Subject to any disclaimer, the term of this patent is extended or adjusted under 35 U.S.C. 154(b) by 737 days.

(21) Appl. No.: 10/478,044

(22) PCT Filed: May 18, 2001

(86) PCT No.: PCT/JP01/04188

§ 371 (c)(1),
(2), (4) Date: Nov. 17, 2003

(87) PCT Pub. No.: WO02/094405

PCT Pub. Date: Nov. 28, 2002

(65) Prior Publication Data

US 2004/0137936 A1 Jul. 15, 2004

(51) Int. Cl.
*A63H 30/00* (2006.01)

(52) U.S. Cl. ..... 341/176; 340/825.69; D21/566; 446/454; 446/456

(58) Field of Classification Search ..... 341/176; 340/925.69; D21/566; 446/454–456, 431, 446/442, 443, 448
See application file for complete search history.

(56) References Cited

U.S. PATENT DOCUMENTS

| | | | |
|---|---|---|---|
| 5,094,646 | A | 3/1992 | Marceau |
| 5,994,853 | A | 11/1999 | Ribbe |

FOREIGN PATENT DOCUMENTS

| | | | |
|---|---|---|---|
| JP | 62-155572 | | 7/1987 |
| JP | 62-043600 | | 9/1987 |
| JP | 3-24239 | Y2 | 5/1991 |
| JP | 10-314463 | A | 12/1998 |
| WO | WO 02/094405 | A1 | 11/2002 |

OTHER PUBLICATIONS

Examiner's Report dated May 17, 2006, from related Japanese Patent Application No. 2002-591116 (2pgs + translation (2pgs)).
International Search Report mailed Aug. 7, 2001, in related International Application No. PCT/JP01/04188, filed May 18, 2001.

*Primary Examiner*—Wendy R. Garber
*Assistant Examiner*—Hung Q Dang
(74) *Attorney, Agent, or Firm*—Young Law Firm, P.C.

(57) ABSTRACT

A transmitter for radio control with rotary control means on its both sides is provided.

10 Claims, 6 Drawing Sheets

TRANSMITTER FOR RADIO CONTROL

TECHNICAL FIELD

This invention relates to a transmitter for radio control, and also to a transmitter for radio control, which has steering wheels being highly operable to both left-handed and right-handed operators.

BACKGROUND ART

There are two kinds of transmitters for radio-controlling radio-controlled toy vehicles, wherein, for example, the first kind has a stick type control unit and the second kind has a wheel type control unit. The stick type one is a transmitter for radio control, wherein a stick is operated for controlling both resistances to generations of a steering control signal and of a speed control signal. In accordance with the transmitter for radio control having two-channels for transmission signals, two of the stick with the same shape are provided in right and left sides. There is a small difference between the right and left sticks.

On the other hands, the wheel type one is another transmitter for radio control, wherein a steering wheel as a miniature is operated for controlling a resistance to generation of the steering control signal while a throttle trigger is operated for controlling another resistance to generation of the speed control signal. Control to the steering wheel is made by a rotational motion of the miniature steering wheel. This control is easy as a rotational motion of the vehicle is similar to the rotational motion of the wheel.

If the control means comprises the wheel and the throttle trigger which are quite different in shape from each other, then they are asymmetrically placed on the transmitter for radio control. Usually, they are arranged so that the left hand operates the throttle trigger, while the right hand operates the wheel. This configuration is suitable for the right-handed user, but unsuitable for the left-handed user.

Due to the quite difference in shape of the control means, the problem can not be solved by simply exchanging both functions, wherein the wheel is used for speed control while the throttle trigger is used for steeling control.

Taking into account that the number of the left-handed persons is smaller, manufacturing of the transmitter for radio control customized for the left-handed user is unprofitable, and actually difficult.

Accordingly, an object of the present invention is to provide a wheel type transmitter for radio control being easily operable to both the right-handed and left-handed users.

DISCLOSURE OF INVENTION

In order to solve the above issues, a transmitter for radio control in accordance with the present invention is provided with rotational control means on its both sides.

The rotational control means on its both sides are co-axially coupled to each other so that the rotational control means exhibit synchronous rotations with each other.

The rotational control means on the both sides drive a variable resistance for left-and-right directional controls, so as to allow rotational control on the both sides of the transmitter.

The variable resistances are electrically connected to a control IC through a switch for switching a right-handed-operation and a left-handed-operation.

The switch for switching the right-handed-operation and the left-handed-operation inverts a polarity of a signal for left-and-right directional controls, so that, in accordance with either one of right-and-left-handed operations, a right rotation operation of the rotation control means causes a controlled article to turn right, while a left rotation operation of the rotation control means causes the controlled article to turn left.

The control IC is connected to a variable resistance for a forward-and-backward control and a modulating circuit for transmitting a control signal, which comprises a forward-and-backward control signal and a left-and-right control signal, to said modulating circuit, and the modulating circuit is connected through a high frequency oscillator to a crystal oscillator for modulating the control signal with a high frequency signal, and the modulating circuit is connected through a high frequency amplifier to an antenna for transmission of a control radio signal, whereby either one of the right-handed user and the left-handed user is allowed to transmit the transmission signal.

The rotational control means on the both sides comprise a right-handed wheel and a left-handed wheel which are co-axially coupled to each other through a rotor, and which are freely rotatable and penetrate a body of the transmitter. At a center of the rotor, a co-axial flange projects so that the flange is made into contact with a knob of the switch for switching the right-handed-operation and the left-handed-operation. A rotor projection, which further projects from the flange, is also made into contact with a horizontal-direction-latch stopper which is slidable in a perpendicular direction with reference to an axis of the rotor on the transmitter. The horizontal-direction-latch stopper also has a stopper recess, thereby to prevent a motion in an axial direction of the rotor in a rotational state, while to allow the motion in said axial direction of the rotor in a neutral state. This allows that a simple push of the rotation control means on the both sides causes the switching operation without any erroneous switching operation in the rotational state.

BRIEF DESCRIPTIONS OF DRAWINGS

BEST MODE FOR CARRYING OUT THE INVENTION

Other details, advantages and characteristics of the present invention will be apparent from the following embodiments to be described with reference to the accompanying drawings.

Figure 1:
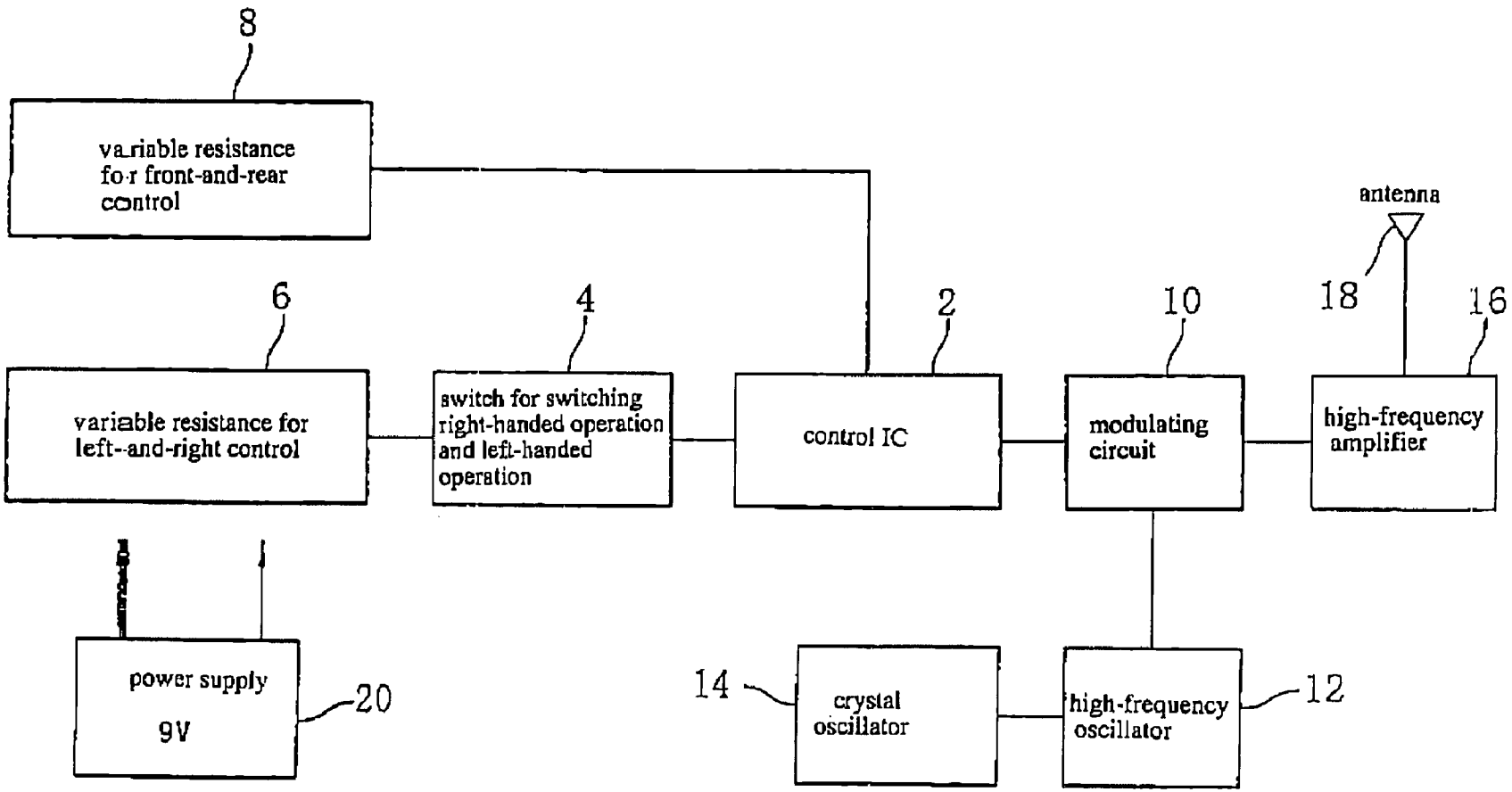
FIG. 1 is a block diagram showing an embodiment of a transmitter for radio control in accordance with the present invention.

As shown in FIG. 1, in accordance with the radio control transmitter of the present invention, a control IC 2 is electrically connected to a variable resistance 6 for left-and-right control through a switch 4 for switching right-handed operation and left-handed operation. The control IC 12 is also electrically connected to a variable resistance 8 for forward-and-backward control and electrically connected to a modulating circuit 10.

The modulating circuit 10 is also electrically connected to a crystal oscillator 14 through a high-frequency oscillator 12. The modulating circuit 10 is further electrically connected to an antenna 18 through a high-frequency amplifier 16. All of the circuits are also connected to a power supply 20.

The control IC 2 varies resistance values of the variable resistance 6 for left-and-right control and the other variable resistance 8 for forward-and-backward control for detecting voltage values or current values as generated, so that the control IC 2 generates signals which decide a velocity and a steering angle, and transmits the generated control signals to the modulating circuit 10. The switch 4 for switching right-handed operation and left-handed operation is operated to change an output from the variable resistance 6 for left-and-right control for transmission to the control IC 2.

The switch 4 for switching right-handed operation and left-handed operation is a switch for switching a right-handed operation mode and a left-handed operation mode. A signal for left-turn in the left-banded mode is the same as a signal for right-turn in the right-handed mode.

The variable resistance 6 for left-and-right control varies its resistance value to generate a signal for changing a direction of travels of the radio controlled toy vehicle, for example, changing a direction of wheels thereof.

The variable resistance 8 for forward-and-backward control varies its resistance value to generate a signal for changing a velocity and a forward-and-backward direction of the radio controlled toy vehicle.

The modulating circuit 10 receives an basic radio wave generated by the crystal oscillator 14 in cooperation with the high-frequency oscillator 12, and also receives the control signal generated by the control IC 2, so that the modulating circuit 10 modulates the control signal in accordance with the basic radio wave. The modulating circuit 10 shows an FM-modulation normally, even another PCM-modulation is also available.

The high-frequency amplifier 16 amplifies the modulated control signal for transmission of the amplified control signal through the antenna 18.

All of the above-described circuits are also connected to the power supply 20.

Figure 2:
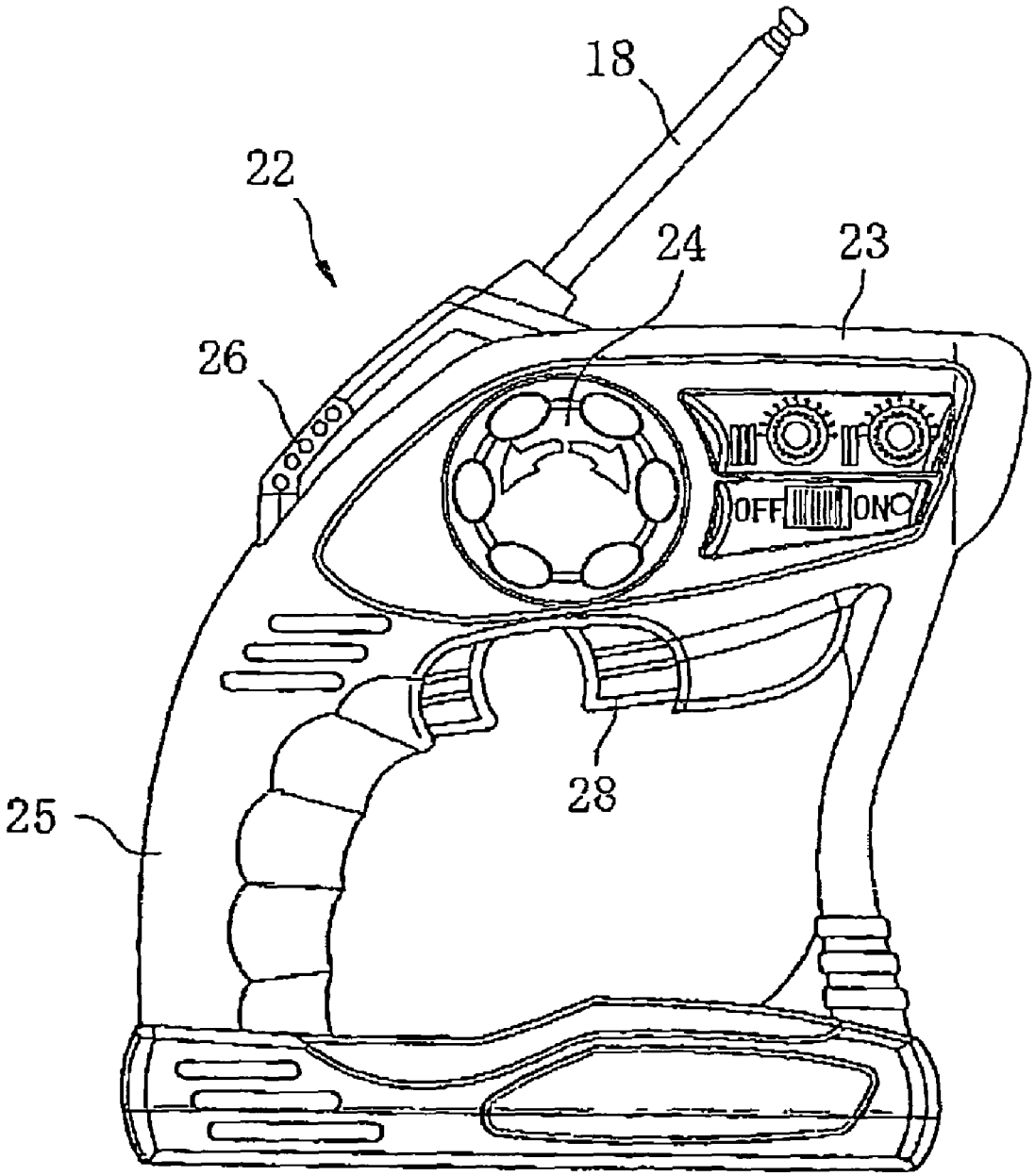
FIG. 2 is a front view showing an embodiment of a transmitter for radio control in accordance with the present invention.

FIG. 2 is a front view showing the radio control transmitter in accordance with the embodiment of the present invention. A right-handed-operation wheel 24 is provided at a center of an upper portion of a transmitter body 23. A stopper 26 is provided in a left side of the right-handed-operation wheel 24. Inside the transmitter, the right-handed-operation wheel 24 is coupled to the variable resistance 6 for left-and-right control.

A throttle trigger 28 is provided under the right-handed-operation wheel 24. Inside the transmitter, the throttle trigger 28 is coupled to the variable resistance 8 for forward-and-backward control. A grip 25 is arranged in the left-side of and under the right-handed-operation wheel 24. In the right-handed mode, the front side of the transmitter faces to the user.

The grip 25 is handled by the left hand to enable the forefinger of the left hand to trigger, while the right-handed-operation wheel 24 is operated by the right hand. The transmitter is positioned in use so that the front side thereof faces to the user. In the right-handed mode, right-rotation of the right-handed wheel 24 causes the radio controlled toy vehicle to tun right, while left-rotation of the right-handed wheel 24 causes the radio controlled toy vehicle to turn left.

Figure 3:
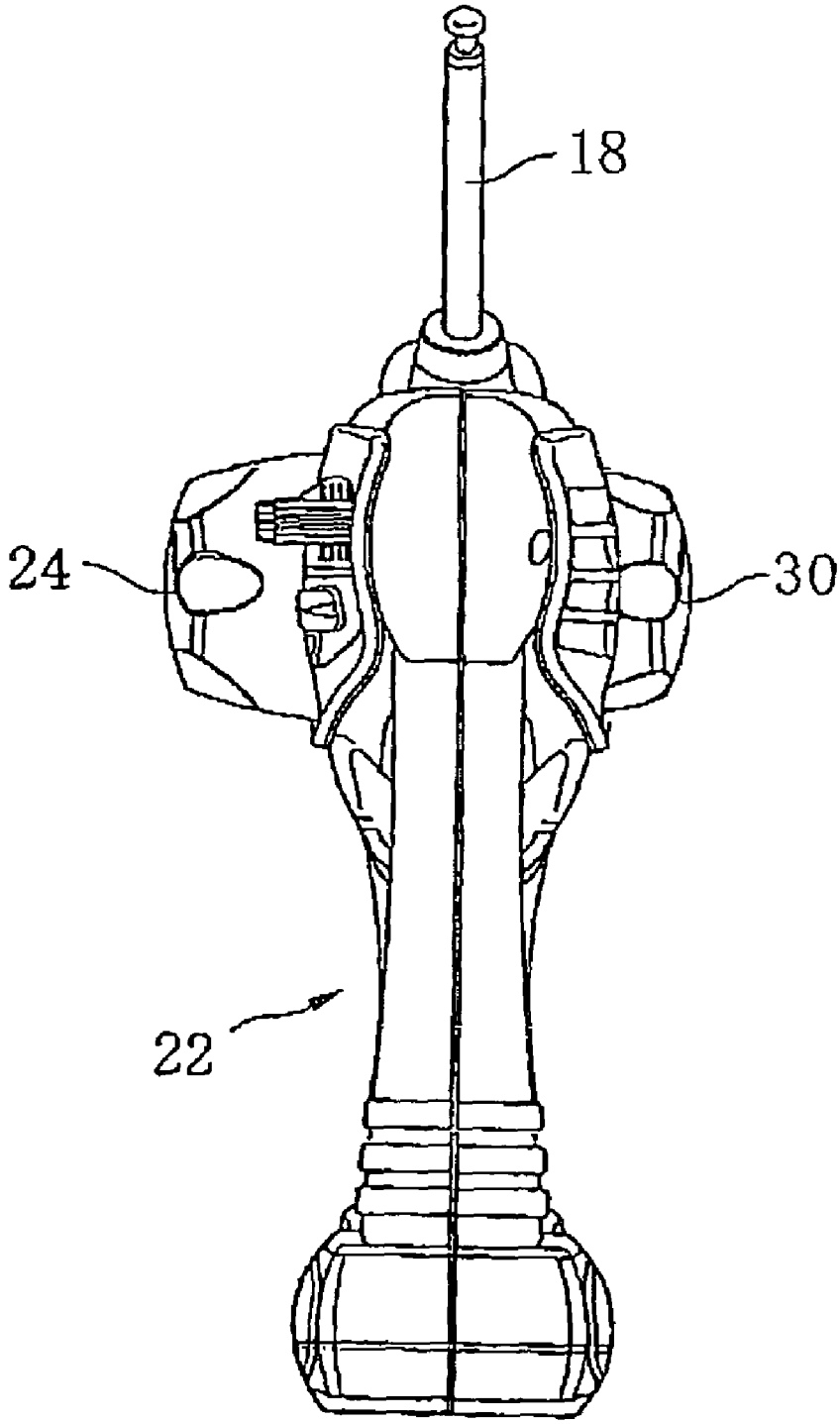
FIG. 3 is a right side view showing an embodiment of a transmitter for radio control in a right-handed operation mode in accordance with the present invention.

FIG. 3 is a right side view showing the radio control transmitter in the right-handed mode in accordance with the embodiment of the present invention. The transmitter 22 is placed in the right-handed mode, wherein the right-handed-operation wheel 24 remarkably projects from the transmitter 22 as compared to a left-handed-operation wheel 30.

Figure 4:
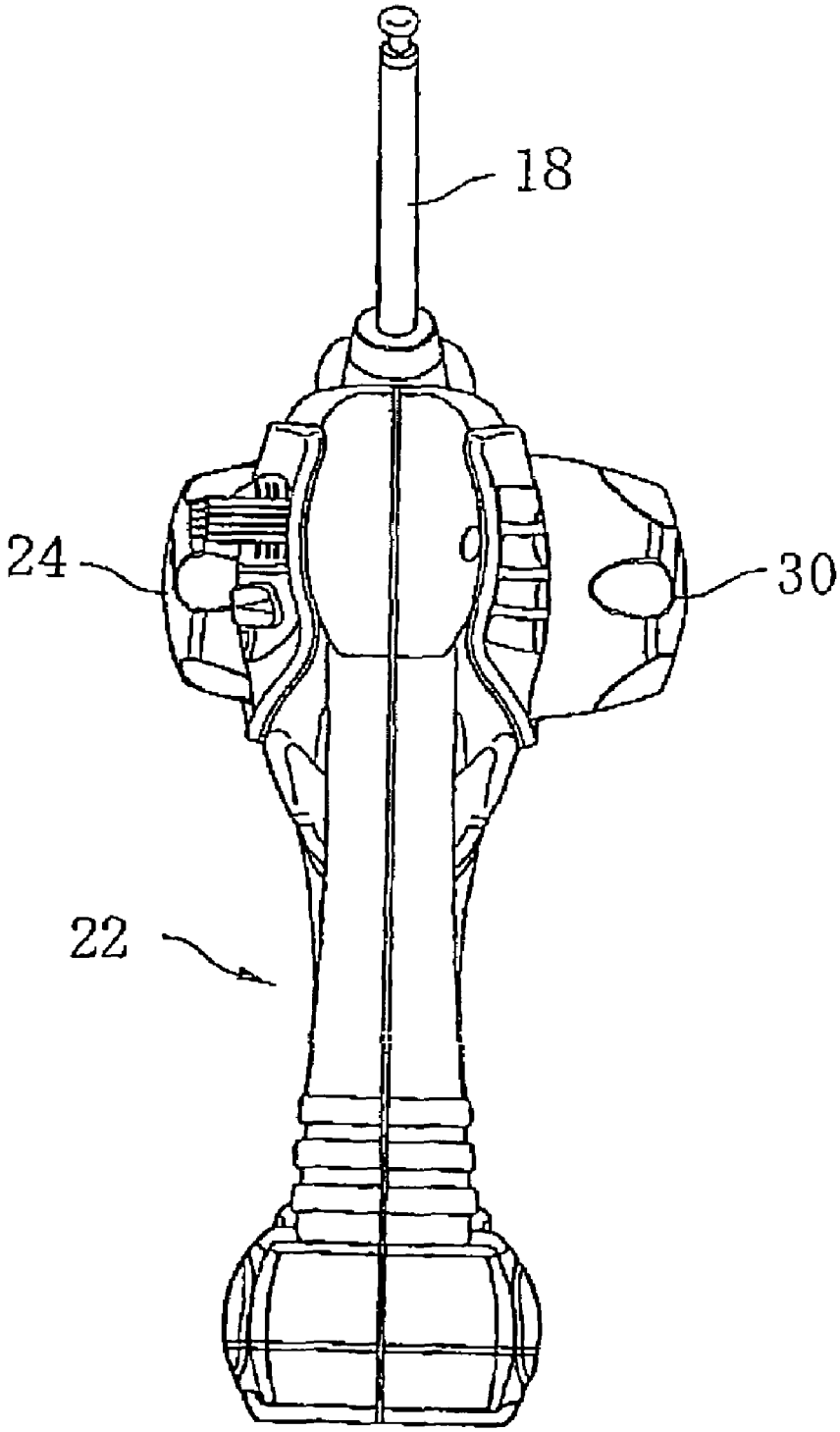
FIG. 4 is a left side view showing an embodiment of a transmitter for radio control in a left-handed operation mode in accordance with the present invention.

FIG. 4 is a right side view showing the radio control transmitter in the left-handed mode in accordance with the embodiment of the present invention. The transmitter 22 is placed in the left-handed mode, wherein the left-handed-operation wheel 30 remarkably projects from the transmitter 22 as compared to the right-handed-operation wheel 24.

Figure 5:
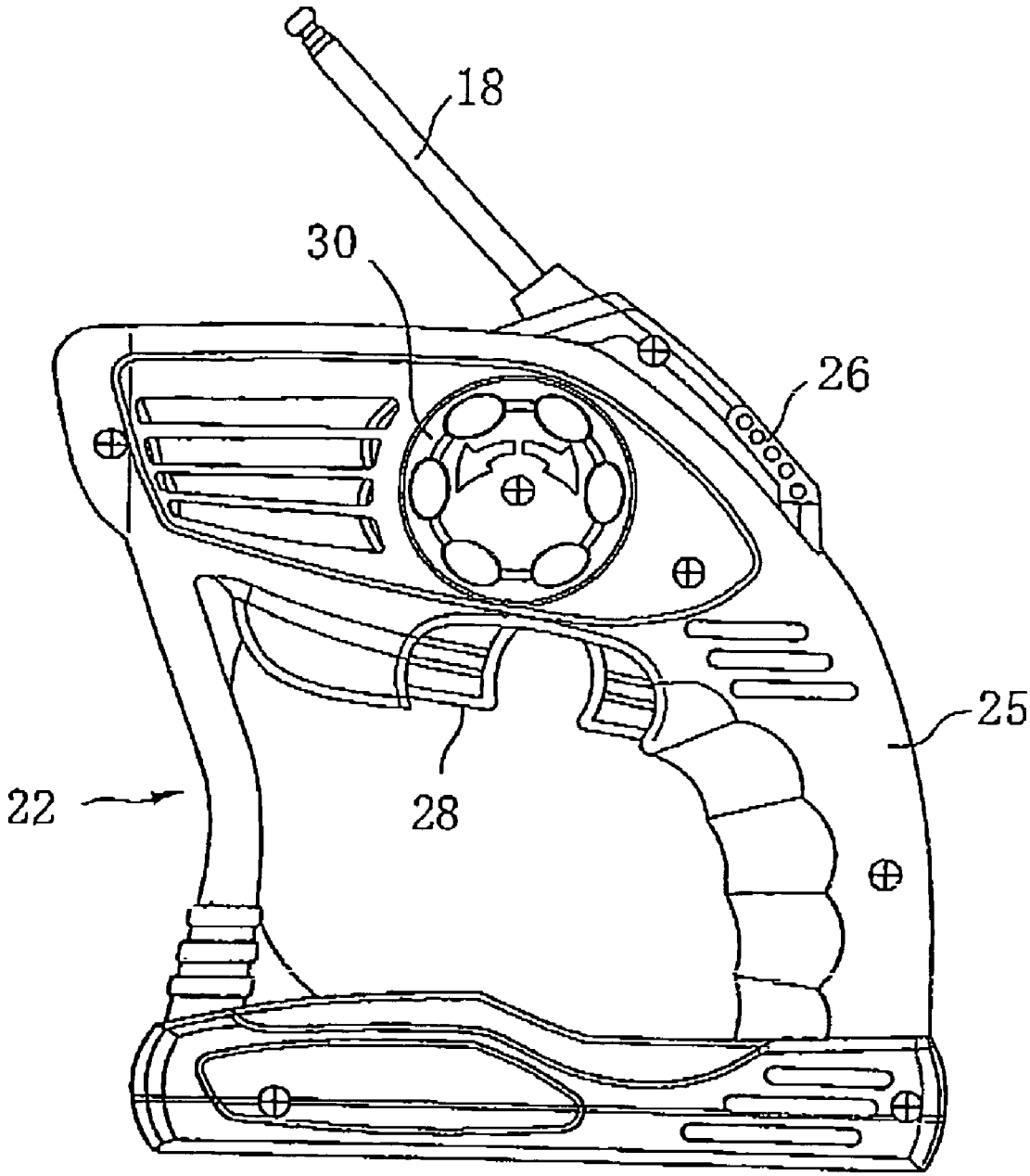
FIG. 5 is a rear view showing an embodiment of a transmitter for radio control in accordance with the present invention.

FIG. 5 is a backside view of the radio control transmitter in accordance with the embodiment of the present invention. The throttle trigger 28 is provided under the left-banded-operation wheel 30. The grip 25 is positioned in the right side of and under the throttle trigger 28. In the backside view, the grip 25 is handled by the right hand to enable the forefinger of the right hand to trigger, while the left-handed-operation wheel 30 is operated by the left hand. In the left-handed mode, the transmitter is positioned in use so that the backside of the transmitter faces to the user. The transmitter is used so that the backside thereof faces to the user in the left-handed mode, in which right-rotation of the left-handed-operation wheel causes the radio controlled toy vehicle to turn right, while left-rotation of the left-handed-operation wheel causes the radio controlled toy vehicle to turn left. Left-rotation of the right-handed-operation wheel 24 in the front view causes the left-handed wheel 30 to turn left, because the right-handed-operation wheel 24 and the left-handed-operation wheel 30 are coaxially coupled to each other. With placing the stopper 26 in a pulled state, the right-handed-operation wheel 24 is pushed to change or switch the right-handed mode into the left-handed mode.

Figure 6:
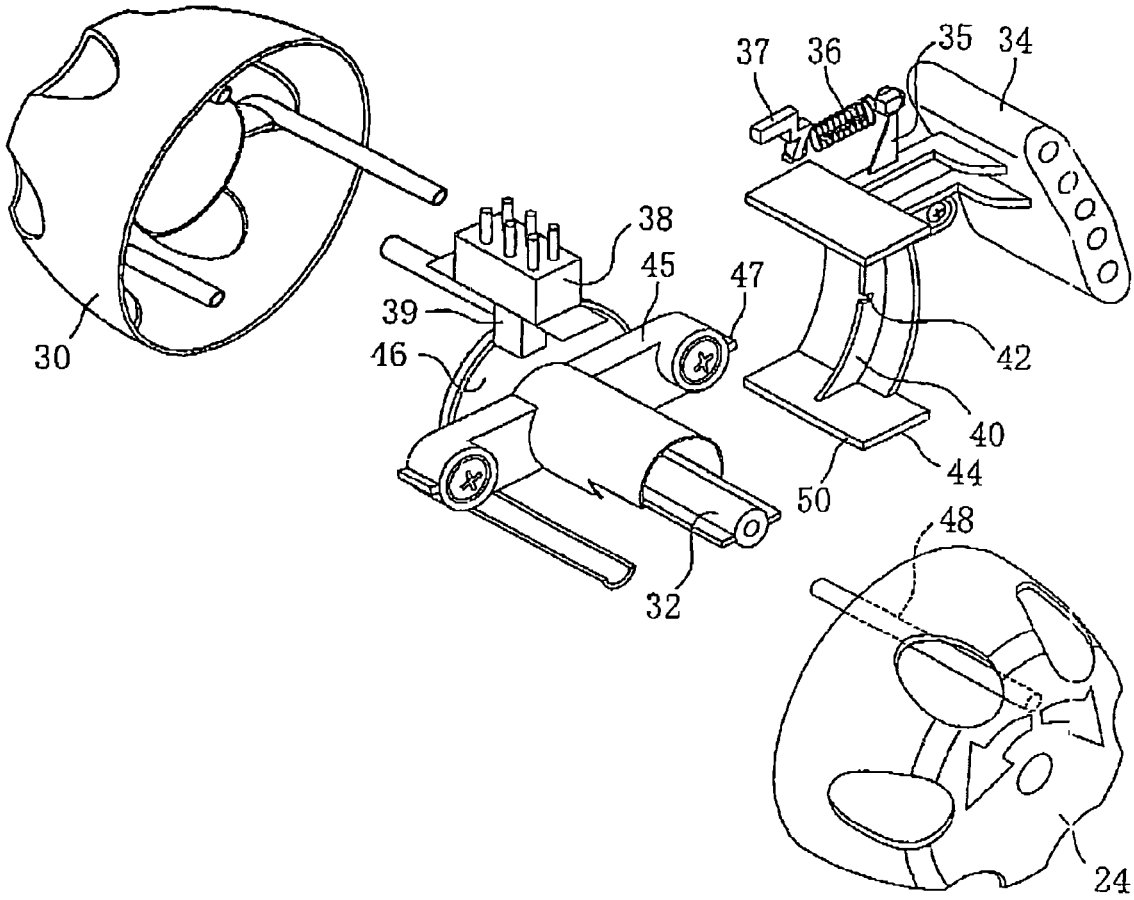
FIG. 6 is a schematic view showing a rotational structure of a transmitter for radio control in accordance with the present invention.

FIG. 6 is a schematic view of a rotary structure of the radio control transmitter in accordance with the embodiment of the present invention, wherein respective parts are spatially separated from each other, while illustration of wirings of the switch for switching right-handed operation and left-handed operation is omitted. A mode-switching mechanism according to the present invention comprises a rotor 32, a stopper 34, the right-handed-operation wheel 24 and the left-handed-operation wheel 30. The rotor 32 is also connected to the variable resistance for left-and-right control, even illustration thereof is omitted.

The right-handed-operation wheel 24 and the left-handed wheel 30 are coaxially coupled to each other through the rotor 32, so that the right-banded-operation wheel 24 and the left-handed-operation wheel 30 are free to rotate and penetrate the transmitter body 22. The rotor 32 has a coaxial flange 46 which projects from the rotor 32, so that the flange 46 may be made into contact with a switch knob 39 for switching right-handed operation and left-handed operation. The switch knob 39 for switching right-handed operation and left-handed operation may be made into contact with a rod 48 attached to an inside wall of the right-handed-operation wheel 24. A unit of the right-handed-operation wheel 24 and the rotor 32 is allowed to rotate around and slidable along its center axis. The switch knob 39 for switching right-handed operation and left-handed operation is interposed between the flange 46 and the rod 48, so that the switch knob 39 for switching right-handed operation and left-handed operation is slidable along the center axis together with the flange 46 and the rod 48.

A rotor projection 47 further projects from the flange 46. The rotor projection 47 may be made into contact with a horizontal-direction-latch stopper 40 provided on the stopper 34 which is slidable in a direction perpendicular to the axis of the rotor 32, so that the horizontal-direction-latch stopper 40 stops the rotor projection 47. The horizontal-direction-latch stopper 40 has a stopper recess 42. If the rotor 32 is in a neutral state, or if a rotor arm 45 is made parallel to the rotor 32 and the stopper 34 and further the stopper 34 moves in an opposite direction to the rotor 32, then the rotor projection 47 is allowed to pass through the stopper recess 42, whereby the rotor 32 becomes slidable along the center axis.

Operations of the radio control transmitter with the above structure in accordance with the present invention will be described.

Normally, the transmitter is set in the right-handed mode. In this right-handed mode, the right-handed-operation wheel 24 projects in a right direction in FIG. 6. The rotor projection 47 is positioned in a right side of the horizontal-direction-latch stopper 40. The switch knob 39 for switching right-handed operation and left-handed operation is positioned in this side of the horizontal-direction-latch stopper 40.

In the right-handed mode, in view of the front of the transmitter, the right-rotation of the right-handed-operation wheel 24 transmits a right-turn-signal to the radio-controlled toy vehicle. The left-rotation of the right-handed-operation wheel 24 transmits a left-turn-signal to the radio-controlled toy vehicle. The right-handed-operation wheel 24 is inhibited to move in the left direction and keeps the right-handed mode, unless the right-handed-operation wheel 24 is positioned at a neutral position and the stopper 34 is pulled in the right-upper direction in that drawing.

If the right-handed-operation wheel 24 is returned to the neutral position and the stopper 34 is pulled in the right-upper direction in that drawing, then pushing the right-handed-operation wheel 24 in the left-direction causes that the rod 48 attached to the inside wall of the right-handed-operation wheel 24 pushes, in the left direction, the switch knob 39 for switching right-handed operation and left-handed operation, whereby the transmitter is shifted into the left-handed mode.

In the left-handed mode of the transmitter, the left-handed-operation wheel 30 projects in a left direction in FIG. 6. The rotor projection 47 is positioned in a left side of the horizontal-direction-latch stopper 40.

In the left-handed mode, in view of the rear of the transmitter, the right-rotation of the left-handed-operation wheel 30 transmits the right-turn-signal to the radio-controlled toy vehicle. The revise-direction-rotation thereof or the left-rotation thereof transmits the left-turn-signal to the radio-controlled toy vehicle. The right rotation of the left-handed-operation wheel 30 in the front side view causes the left rotation of the right-handed-operation wheel 24 in the rear side view. In the left-handed mode, however, a switch 38 for switching right-handed operation and left-handed operation is so set to give a priority to the rotation direction of the left-handed-operation wheel 30.

Operations of the circuit of the transmitter will subsequently be described with reference to FIG. 1.

If the switch 4 for switching right-handed operation and left-banded operation is in the right-handed mode, variation of the variable resistance 6 for left-and-right control causes variation of an output voltage therefrom or in an output current therefrom so that the varied output is transmitted through the switch 4 for switching right-handed operation and left-handed operation, whereby either in the left-handed mode or in the right-handed mode, the switch outputs the left-turn-signal as the left-and-right control signal for causing the radio-controlled toy vehicle to turn left, and the switch outputs the right-turn-signal as the left-and-right control signal for causing the radio-controlled toy vehicle to turn right. This left-and-right control signal is transmitted to the control IC. Independently from the left-and-right control signal, the forward-and-backward control signal generated by the variable resistance 8 for forward-and-backward control is also transmitted to the control IC In the sequence of inputs, the control IC synthesizes the forward-and-backward control signal and the left-and-right control signal and then transmits it to the modulation circuit. The crystal oscillator 14 generates an original oscillation, and then the high-frequency oscillator 12 generates a basic radio wave. The modulating circuit 10 modulates the control signal from the control IC in accordance with the basic radio wave. The modulated radio wave as modulated by the modulating circuit is transmitted to the high frequency amplifier for amplification thereof and then transmitted to the antenna.

In accordance with the above-described operations, the wheel-type transmitter for radio control allows both the right-handed and left-handed users to perform easy operation thereof.

It is, for example, possible to operate the wheel in either side of the transmitter. The steering direction of the vehicle corresponds to rotation direction of the transmitter wheel in either side. The single variable resistance for left-and-right directional control is used commonly to both the right-handed-operation wheel 24 and the left-handed-operation wheel 30, so that both the operabilities in both sides are the same as each other. This allows the user to operate the wheel with not only the dominant hand but also another hand, that the user feels more comfortable in use.

The change to the transmitter mode is made when the wheels are positioned at the neutral position and also the stopper is pulled, for establishing a double locking system to prevent any erroneous operations.

The production of the wheel type transmitter for radio control commonly operable to the left-handed and right-handed users does mean it unnecessary to produce separately both the different wheel type transmitters for radio control for the left-handed and right-handed users.

What is claimed is:

1. A transmitter for radio control including:

a single pair of rotational control elements on opposite sides of a body of said transmitter, said rotational control elements being co-axially coupled to each other, and said rotational control elements being for right-handed operation and left-handed operation, respectively;

a first variable resistance for left-and-right direction control being adopted by a common rotational operation of said rotational control elements, and a switch being electrically coupled to said first variable resistance for switching an electrical output from said first variable resistance, and said switch being further mechanically linked to said single pair of rotational control elements for switching functionally effective one of said rotational control elements for switching right-handed-operation and left-handed-operation.

2. The transmitter for radio control as claimed in claim 1, wherein said switch for switching right-handed-operation and left-handed-operation inverts a polarity of said electrical output.

3. The transmitter for radio control as claimed in claim 1, further including:

a second variable resistance for forward-and-backward controls being electrically coupled to said control circuit;

a modulating circuit being electrically coupled to said control circuit for modulating a control signal, which comprises a forward-and-backward control signal and a left-and-right control signal, with a high frequency signal from a high frequency signal generator;

a high frequency amplifier being electrically coupled to said modulating circuit for receiving a modulated signal from said modulating circuit and amplifying said modulated signal, and an antenna being electrically coupled to said high frequency amplifier for receiving an amplified signal from said high frequency amplifier and transmitting a control radio signal.

4. The transmitter for radio control as claimed in claim 1, wherein said single pair of rotational control elements comprises a right-handed operation wheel and a left-handed operation wheel which are co-axially coupled to each other through a rotor, and which are rotatable and movable under control of said switch in a direction parallel to an axis of said rotor for switching functionally effective one of said rotational control elements for switching right-handed-operation and left-handed-operation.

5. The transmitter for radio control as claimed in claim 4, further including:

a flange co-axially projecting from said rotor;

a switch knob being functionally coupled to said switch for switching right-handed-operation and left-handed-operation, and said switch knob being also made into contact with said flange;

a rotor projection projecting from said rotor in a direction perpendicular to an axis of said rotor, and a horizontal-direction-latch stopper being slidable with reference to said rotor projection in a direction perpendicular to said axis of said rotor, and said horizontal-direction-latch stopper having a stopper recess, and said horizontal-direction-latch stopper being so movable as distanced from said rotor projection, so that if said horizontal-direction-latch stopper is in contact with said rotor projection, then said rotor and said rotor projection is prevented from moving in parallel to said axis of said rotor, and if said horizontal-direction-latch stopper is distanced from said rotor projection and further said rotor projection is aligned to said recess, then while said rotor and said rotor projection is allowed to move in parallel to said axis of said rotor so as to switch said functionally effective one of said rotational control elements for switching right-handed-operation and left-handed-operation.

6. A transmitter for radio control including:

a single pair of first and second rotational control elements on opposite sides of a body of said transmitter, said rotational control elements being coupled to each other on a co-axis, and said rotational control elements being for right-handed operation and left-handed operation, respectively, and a switch mechanism being mechanically linked to said single pair of first and second rotational control elements for controlling said single pair of first and second rotational control elements to move in said co-axis for switching functionally effective one of said first and second rotational control elements for switching right-handed-operation and left-handed-operation.

7. The transmitter for radio control as claimed in claim 6, wherein said switch mechanism further includes:

a rotor mechanically coupling said first and second rotational control elements;

a rotor projection projecting from said rotor in a direction perpendicular to an axis of said rotor, and a horizontal-direction-latch stopper being slidable with reference to said rotor projection in a direction perpendicular to said axis of said rotor, and said horizontal-direction-latch stopper having a stopper recess, and said horizontal-direction-latch stopper being so movable as distanced from said rotor projection, so that if said horizontal-direction-latch stopper is in contact with said rotor projection, then said rotor and said rotor projection is prevented from moving in parallel to said axis of said rotor, and if said horizontal-direction-latch stopper is distanced from said rotor projection and further said rotor projection is aligned to said recess, then while said rotor and said rotor projection is allowed to move in parallel to said axis of said rotor so as to switch said functionally effective one of said rotational control elements for switching right-handed-operation and left-handed-operation.

8. The transmitter for radio control as claimed in claim 7, further including:

a first control signal generator for generating a first control signal for left-and-right direction controls, and said first control signal being adopted by a common rotational operation of said rotational control elements, and said first control signal generator being also electrically coupled to said switch mechanism for allowing said move of said single pair of first and second rotational control elements in said co-axis to change a polarity of said control signal for left-and-right direction controls.

9. The transmitter for radio control as claimed in claim 8, further including:

a second control signal generator for generating a second control signal for forward-and-backward controls, and an electrical control circuit being electrically coupled to said first control signal generator and said switch mechanism for synthesizing both said first and second control signals to generate a synthesized control signal.

10. The transmitter for radio control as claimed in claim 9, further including:

a high frequency signal generator for generating a high frequency signal;

a modulating circuit being electrically coupled to said electrical control circuit and said high frequency signal generator for modulating said synthesized control signal with said high frequency signal to generate a high-frequency-modulated control signal;

a high frequency amplifier being electrically coupled to said modulating circuit for amplifying said high-frequency-modulated control signal to generate an amplified control signal, and an antenna being electrically coupled to said high frequency amplifier for receiving said amplified control signal and transmitting a control radio signal.

* * * * *